US011044789B2

(12) United States Patent
Hu et al.

(10) Patent No.: US 11,044,789 B2
(45) Date of Patent: Jun. 22, 2021

(54) THREE DIMENSIONALLY PRINTED HEATED POSITIVE TEMPERATURE COEFFICIENT TUBES

(71) Applicant: Goodrich Corporation, Charlotte, NC (US)

(72) Inventors: Jin Hu, Hudson, OH (US); Daniel Waina, Uniontown, OH (US); Casey Slane, Tallmadge, OH (US); Nathaniel Ching, Hartville, OH (US); Galdemir Cezar Botura, Akron, OH (US)

(73) Assignee: Goodrich Corporation, Charlotte, NC (US)

( * ) Notice: Subject to any disclaimer, the term of this patent is extended or adjusted under 35 U.S.C. 154(b) by 265 days.

(21) Appl. No.: 16/157,775

(22) Filed: Oct. 11, 2018

(65) Prior Publication Data

US 2020/0120760 A1 Apr. 16, 2020

(51) Int. Cl.

*H05B 3/48* (2006.01)
*H05B 3/03* (2006.01)
*H05B 3/18* (2006.01)

(52) U.S. Cl.

CPC ..... *H05B 3/48* (2013.01); *H05B 3/03* (2013.01); *H05B 3/18* (2013.01); *H05B 2203/007* (2013.01); *H05B 2203/013* (2013.01); *H05B 2203/016* (2013.01); *H05B 2203/017* (2013.01); *H05B 2203/02* (2013.01); *H05B 2203/021* (2013.01)

(58) Field of Classification Search

CPC ... H05B 3/48; H05B 3/03; H05B 3/18; H05B 2203/007; H05B 2203/017; H05B 2203/016; H05B 2203/02; H05B 2203/021; H05B 2203/2203; H05B 2203/013

USPC ..... 219/213, 494, 529, 548, 549

See application file for complete search history.

(56) References Cited

U.S. PATENT DOCUMENTS

| | | | | |
|---|---|---|---|---|
| 8,367,986 | B2 | 2/2013 | Von Wachenfeldt et al. | |
| 9,161,393 | B2 | 10/2015 | Kaiserman et al. | |
| 9,736,888 | B2 | 8/2017 | Duce et al. | |
| 9,939,087 | B2 | 4/2018 | Kolarski et al. | |
| 9,942,947 | B2 | 4/2018 | Maher et al. | |
| 2010/0065542 | A1* | 3/2010 | Dubey | H05B 3/34 219/213 |
| 2011/0061422 | A1 | 3/2011 | Lee | |

(Continued)

FOREIGN PATENT DOCUMENTS

| | | |
|---|---|---|
| CA | 2732858 A1 | 8/2012 |
| DE | 1152639 B | 8/1963 |

(Continued)

OTHER PUBLICATIONS

Extended European Search Report for EP Application No. 19201952.9, dated Dec. 18, 2019, pp. 16.

(Continued)

*Primary Examiner* — Thien S Tran

(74) *Attorney, Agent, or Firm* — Kinney & Lange, P.A.

(57) ABSTRACT

Additively manufactured heating elements for tubes are made from a positive temperature coefficient heater ink printed on the tube. A bus bar is likewise printed onto the tube using a conductive ink. The positive temperature coefficient heater ink and bust bar conductive ink are encapsulated with a closing adhesive.

20 Claims, 10 Drawing Sheets

(56) References Cited

U.S. PATENT DOCUMENTS

| | | | | |
|---|---|---|---|---|
| 2014/0071216 | A1* | 3/2014 | Hu | H05B 3/12 347/102 |
| 2016/0312924 | A1* | 10/2016 | Kolarski | F16L 53/37 |
| 2017/0231811 | A1* | 8/2017 | Cubon | A61F 7/0097 607/110 |
| 2017/0327707 | A1 | 11/2017 | Xiao et al. | |
| 2018/0063886 | A1 | 3/2018 | Shearer et al. | |
| 2018/0071480 | A1 | 3/2018 | Tang et al. | |
| 2018/0094434 | A1 | 4/2018 | Gillissen et al. | |

FOREIGN PATENT DOCUMENTS

| | | | | | |
|---|---|---|---|---|---|
| DE | 10315220 | A1 | | 10/2004 | |
| DE | 102012213385 | A1 | | 5/2014 | |
| EP | 1152639 | A2 | | 11/2001 | |
| EP | 3145273 | A1 | | 3/2017 | |
| GB | 2324014 | A | | 4/1998 | |
| JP | 2001284030 | A | | 10/2001 | |
| JP | 2011238559 | A | * | 11/2011 | |
| WO | WO-2017147480 | A1 | * | 8/2017 | C09D 11/52 |

OTHER PUBLICATIONS

Communication Pursuant to Article 94(3) EPC for EP Application No. 19201952.9, Dated Dec. 17, 2020, pp. 6.
First Third Party Observation for EP Application No. 19201952.9, Dated Jul. 28, 2020, pp. 5.
Second Third Party Observation for EP Application No. 19201952.9, Dated Dec. 9, 2020, pp. 3.

* cited by examiner

THREE DIMENSIONALLY PRINTED HEATED POSITIVE TEMPERATURE COEFFICIENT TUBES

BACKGROUND

This application relates generally to positive temperature coefficient heater elements, and specifically to additively manufactured positive temperature coefficient heater elements.

Heated tubes or tubes are used in a variety of industries to heat fluid passing through such a vessel and prevent unwanted freezing. In prior art, resistor heaters that are spiral wound around the core of the tube or tube are used to provide heat. Alternatively, heater tapes are wrapped around the core of the tube or tube. These types of heating elements require sensors or thermostats to prevent overheating, or the use of positive temperature coefficient of resistance (PTC) heating material to limit overheating. These types of heating elements can be bulky and require excess space around the tubes, in addition to requiring external control.

SUMMARY

In a first embodiment, a heater tube assembly includes a tube, a bus bar network on the tube, a positive temperature coefficient heater on the tube, a closeout adhesive securing the bus bar network and the positive temperature coefficient heater to the tube, and an outer dielectric layer overlaying the bus bar network and the positive temperature coefficient heater. The bus bar network includes one or more layers of a first additively manufactured conductive ink. The positive temperature coefficient heater comprising one or more layers of a second additively manufactured conductive ink. The positive temperature coefficient heater is electrically connected to the bus bar network.

In a second embodiment, a heater tube assembly includes a tube, a bus bar network including at least one hot bus bar and at least one neutral bus bar on the tube, a heater on the tube having a thickness between 0.0001 and 0.010 inches, a closeout adhesive securing the bus bar network and the heater to the tube, and an outer dielectric layer overlaying the bus bar network and the heater. The bus bar network is made of one or more layers of a first additively manufactured conductive ink, and the bus bar network is a geometric pattern selected from the group consisting of a spiraled pattern, a redundant dual-circuit pattern, a crisscross pattern, or combinations thereof. The heater includes a plurality of layers of a second additively manufactured conductive ink, each of the plurality of layers has a thickness of between 1 and 100 microns, and the heater is electrically connected to the bus bar network.

In a third embodiment, a method of making a heater tube assembly includes additively manufacturing one or more layers of a first conductive ink on a tube to create a bus bar, additively manufacturing one or more layers of a second conductive ink on a tube to create a positive temperature coefficient heater overlapping with the bus bar, closing out the bus bar and the positive temperature coefficient heater with an adhesive, and encapsulating the bus bar and the positive temperature coefficient heater with an outer dielectric layer.

DETAILED DESCRIPTION

Disclosed are flexible printed heating elements made via additive manufacturing with conductive inks. A flexible substrate is used so that the printed heating element can conform to the shape of the component surface to which it is applied. A self-limiting positive temperature coefficient (PTC) heating material is used.

Figure 1A:
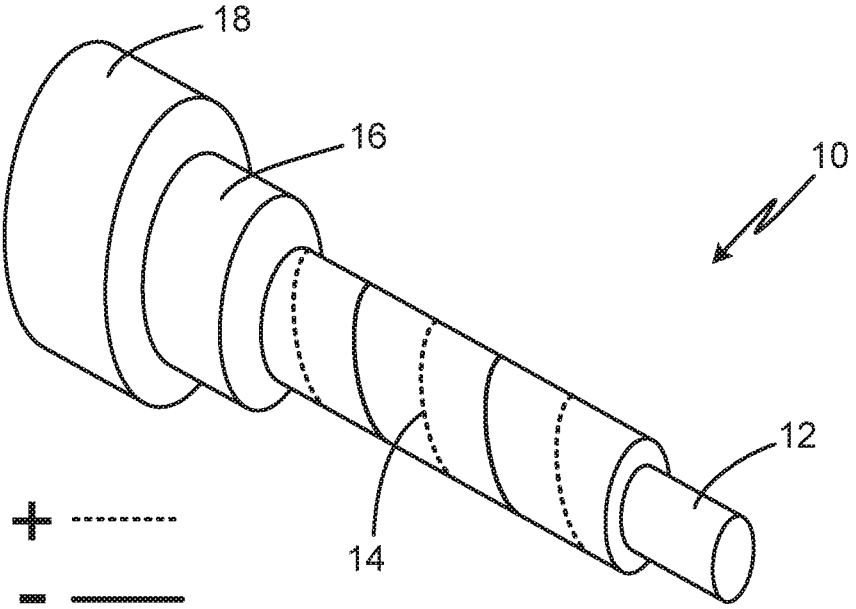
Fig. 1A PRIOR ART
FIGS. 1A-1B are perspective views of a prior art heater wire tube configuration.
Figure 1B:
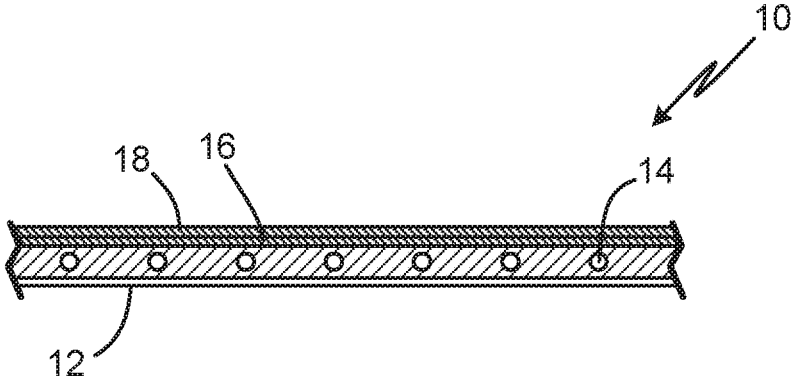
Fig. 1B PRIOR ART

FIGS. 1A-1B are views of prior art heater wired tube 10. FIG. 1A shows a perspective, cut-away view of tube 10, while FIG. 1B shows a side view schematic of one wall of tube 10. FIGS. 1A and 1B will be discussed together. Tube 10 includes PFA liner 12; heater wires 14, stainless steel braid 16, and aramid fiber braid 18.

PFA liner 12 is a perfluoroalkoxy alkane liner inside tube 10. PFA liner is an insulating material inside tube 10 that separates heater wires 14 from fluid passing through tube 10. PFA liner 12 electrically and chemically insulates fluid passing through tube 10 from heater wires 14 and braids 16, 18.

Heater wires 14 provide heat to tube 10, and are spiral wound around tube 10. Heater wires 14 can be, for example polyimide-insulated nichrome. Heater wires 14 may also be embedded in a silicone material. Heater wires 14 are joined at the end of tube 10 to allow for electrical connection to both positive (+) and negative (−) wires at that end. In the case of dual element tubes, there can be two sets of wires wound together. Stainless steel braid 16 and aramid fiber braid 18 provide structural support and protection of heater wires 14. The prior art configuration of tube 10 is bulky due to multiple layers of protection and support in the form or braids 16, 18, and the winding of wires 14 around a core material.

Figure 2:
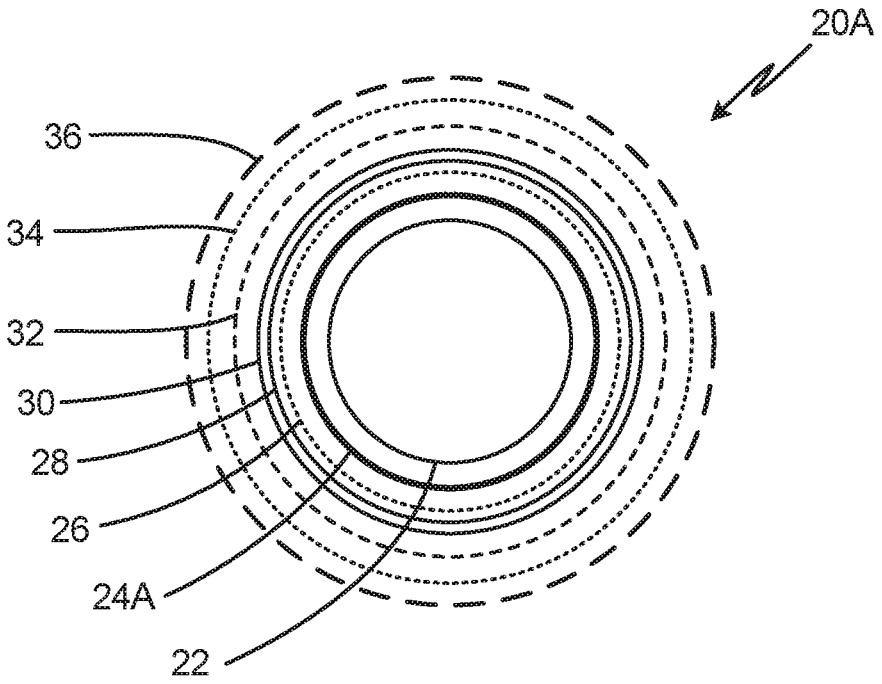
FIG. 2 is a cross-section view of a printed heater tube with a conductive tube.

FIG. 2 is a cross-section view of printed heater tube 20A with conductive tube 24A. From inside to outside, printed heater tube 20A includes liner 22, conductive tube 24A, inner dielectric 26, PTC heater 28, bus bar 30, closeout adhesive 32, outer dielectric 34, and protection layer 36.

Liner 22 rests inside tube 20A for chemical compatibility with the fluid flowing through tube 20A. In some cases, liner 22 is made of a material to allow water potability. Liner 22 can be, for example, a fluoropolymer material (such as polytetrafluoroethylene (PTFE) or perfluoroalkoxy (PFA)), a fluoroelastomer, a silicone, a polyolefin (such as polyethylene or polypropylene), acrylonitrile butadiene rubbers (such as nitrile or NBR), ethylene propylene diene monomer rubbers (such as EPDM), polyurethane (PU), or combinations thereof.

Conductive tube 24A is the structural part of tube 20A through which fluid flows. Conductive tube materials include metals such as stainless steel or titanium. Other types of conductive tube materials include carbon-filled plastics, such as polyetherimide (PEI), polyetheretherketone (PEEK), polyphenylene sulfide (PPS), polyimide (PI), ethylene tetrafluoroethylene (ETFE), polyvinylchloride (PVC), or polyvinylidene difluoride (PVDF) filled with carbon such as carbon black, carbon nanotubes, or carbon fibers.

Inner dielectric 26 isolates conductive tube 24A from bus bar 30 and PTC heater 28. Inner dielectric 26 can be polyimide, polyurethane, silicone, or other materials deemed suitable by a person of skill in the art. If conductive tube 24A is a carbon-filled plastic, then inner dielectric 26 can be the same plastic but un-filled, or glass-filled.

PTC heater 28 is the heating element of heater tube 20. PTC heater 28 is an additively manufactured PTC ink on the surface of inner dielectric 26. PTC heaters are self-regulating heaters that run open loop without any external diagnostic controls. Positive temperature coefficient heaters come to full power and heat up quickly to optimum temperature, but as heat increases, power consumption drops. This dynamic type of heater is effective and time and energy efficient. Thus, PTC heater 28 made with PTC ink does not require an outside temperature control. Examples of PTC inks include DuPont® 7292 from DuPont USA or Henkel® EC1 8060 from Henkel.

The PTC ink of PTC heater 28 is formulated to allow highly detailed precision printing, and maintain a high resistance without bleeding between adjacent additively manufactured lines. The PTC ink is additively manufactured onto inner dielectric 26 through a printing process such as ink-jet, aerosol-jet printing, or other suitable processes.

Typically, ink-jet or aerosol-jet printing can be used to additively manufacture PTC heater 28, depending on the type of PTC ink chosen, desired layer thickness, and dimensions of PTC heater 28. Printing PTC ink may require dilution of the ink to allow precision and prevent print-head clogging. Depending on the specific PTC ink used, the ink may need to be diluted from 1% to 50% with appropriate solvents.

For ink-jet and aerosol-jet methods, the print head should be moveable at least on (x, y, z) axes and programmable with the geometric pattern specific to the component on which PTC heater 28 will be applied. The specific print heat and additively manufacturing method will be dependent on the exact PTC ink formulations and requirements set forth by the manufacturer of the PTC ink. Ink-jet and aerosol-jet printers and printing heads can also be utilized for two dimensional applications, such as printing on a dielectric layer of a non-conductive tube, but ideally can be adapted to enable three dimensional (three dimensional) printing capabilities by attaching the printing heads onto a numerically controlled robotic arm. For example, three dimensional ink-jet and aerosol-jet printing equipment developed by Ultimaker® (three-dimensional ink-jet equipment) or Optomec® (three-dimensional aerosol-jet equipment) can be used. For ink-jet or aerosol-jet methods, the printing head temperatures, flow rates, nozzle sizes are also selected based on the PTC ink being printed, required conductive ink thickness, and substrate to be additive manufactured on. Alternatively, the PTC ink can be deposited or direct printed with extruded ink on the tube using micro-dispensing pumps such as those made by nScrypt®.

The printing is accomplished in an additive manner, meaning the print head takes one or more passes before a desired element resistance is reached in the desired geometric pattern and desired dimensions, which matches the curvature of the component. Depending on the application, two or more, three or more, four or more, or additional passes may be appropriate.

The PTC ink of additively manufactured PTC heater 28 should have a thickness of approximately between 0.0001"-0.010". Multiple passes are done by the print head when applying the conductive ink. Each layer deposited through individual passes of the print head should have a thickness of approximately 1-100 microns. Multiple passes allows for slow buildup of the PTC ink to the correct resistance and geometric pattern. Additionally, multiple passes allows for tailoring of the PTC ink on certain portions of the component surface. For instance, PTC ink with a lower resistance (e.g., with a higher number of layers) and a greater thickness may be additively manufactured on a first portion of the component compared to a second portion of the component.

After additively manufacturing PTC heater 28, the PTC ink is cured. The curing process of additively manufactured PTC heater 28 depends on the type of PTC ink used. In some instances, the PTC ink will air dry. In other instances, heat, infrared exposure, UV exposure, chemical, or other methods can be used to cure the PTC ink. The PTC ink can be cured (partially or fully) during the printing process, to avoid dripping or smearing of the ink during processing.

Bus bar 30 is also additively manufactured onto the surface of inner dielectric 26. Bus bar 30, made of a conductive ink, provide electrical connection from PTC heater 28 to an outside controller (not pictured). Bus bar 30 can be made of a conductive carbon filled or silver filled ink, such as DuPont® 5205 available from DuPont USA or Henkel® EC1 1010 available from Henkel.

Bus bar 30 is additively manufactured in a similar method to that described with reference to PTC heater 28. Generally, bus bar 30 is additively manufactured on top of and overlapping with portions of PTC heater 28 to create an electrical connection between PTC heater 28 and bus bar 30. Specific geometries of bus bar 30 and PTC heater 28 are discussed with reference to FIGS. 4-15 below.

Closeout adhesive 32 seals and encapsulates PTC heater 28 and bus bar 30. Closeout adhesive 32 is applied on top of both PTC heater 28 and bus bar 30 to secure and protect these components, separating them from the external environment. Closeout adhesive 32 can be, for example, an acrylic or rubber pressure sensitive adhesive, or ethylene-vinyl acetate.

Outer dielectric 34 is applied to printed heater tube 20A after closeout adhesive 32 is cured or dried. Outer dielectric 34 electrically insulates bus bar 30 from the external environment, preventing shorting. Outer dielectric 34 can be made of the same or a different dielectric material than inner dielectric 26. Outer dielectric 34 can be, for example, a polyimide, polyurethane, or silicone. If conductive tube 24A is a carbon-filled plastic, then outer dielectric 34 can be made of the same plastic that is unfilled or filled with glass fiber.

Protection layer 36 is an optional external layer of printed heater tube 20A that adds extra protection to PTC heater 28. Protection layer 36 can defend against handling and abrasion damage, and can add pressure strength to the assembly. Protection layer 36 can optionally be conductive for both static discharge and lightning protection. Protection layer 36 can be, for example, a braided metallic wire such as stainless steel or titanium, braided aramid, or braided dry fiberglass. If conductive tube 24A is a rigid tube, then protection layer 36 can alternatively be a carbon fiber or fiberglass composite made with epoxy, phenolic, or benzoxazine resin. Such a carbon fiber or fiberglass composite would be braided or spiral-wound for further strength. Protection layer 36 can alternatively be made of multiple sub-layers.

Figure 3:
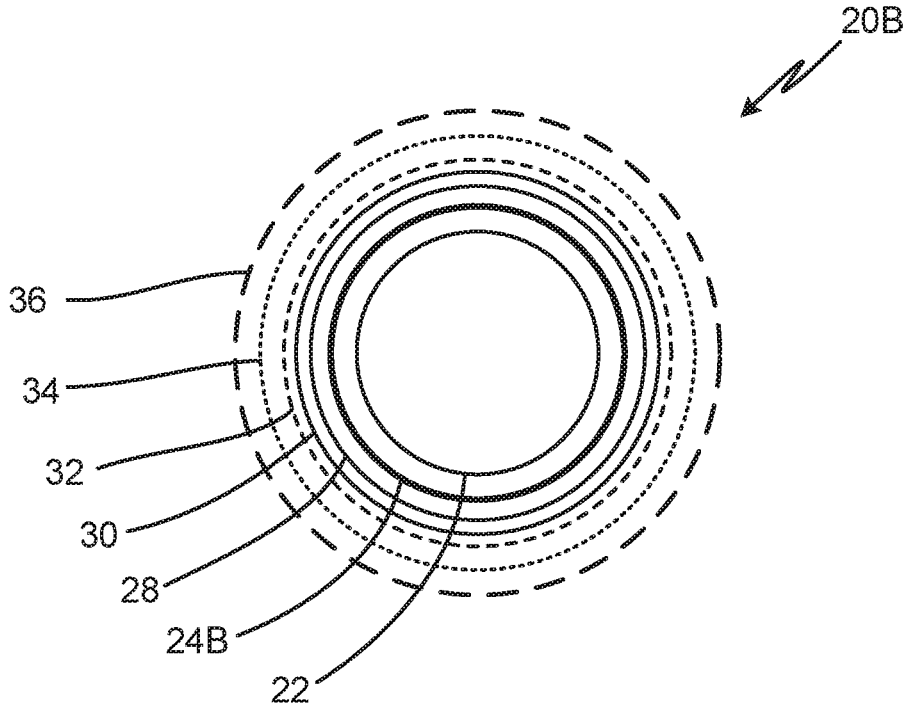
FIG. 3 is a cross-section view of a printed heater tube with a non-conductive tube.

FIG. 3 is a cross-section view of printed heater tube 20B with non-conductive tube 24B. For inside to outside, printed heater tube 20B includes liner 22, non-conductive tube 24B, PTC heater 28, bus bar 30, closeout adhesive 32, outer dielectric 34, and protection layer 36. The components of printed heater tube 20B are the same as tube in printed heater tube 20A except where otherwise noted.

Specifically, non-conductive tube 24B differs from tube 24A of FIG. 2 in that non-conductive tube 24B is made of a material that is not conductive. Tube 24B can be, for example, non-filled or glass-filled plastics such as polyetherimide (PEI), polyetheretherketone (PEEK), polyphenylene sulfide (PPS), polyimide (PI), ethylene tetrafluoroethylene (ETFE), polyvinylchloride (PVC), or polyvinylidene difluoride (PVDF). If non-conductive tube 24B is filled with glass, it can be in the form of spheres, hollow spheres, or fibers.

The use of a non-conductive tube 24B in printed heater tube 20B eliminated the need for inner dielectric 26, as there is no electrical insulation needed between tube 24B and PTC heater 28 (or bus bar 30). For this reason, PTC heater 28 and bus bar 30 can be additively manufactured directly onto the surface of nonconductive tube 24B.

Figure 4:
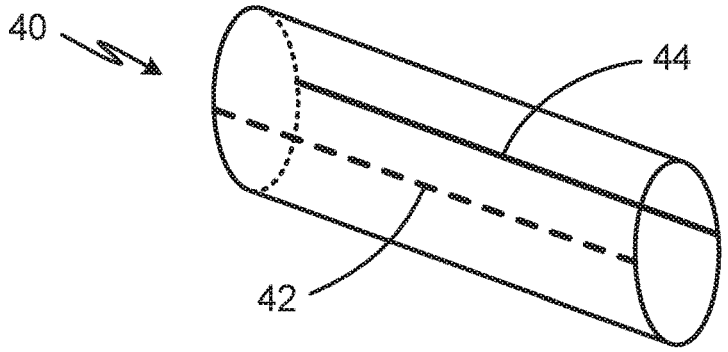
FIGS. 4-6 are perspective views of a printed heater tube with printed bus bars in various patterns.
Figure 5:
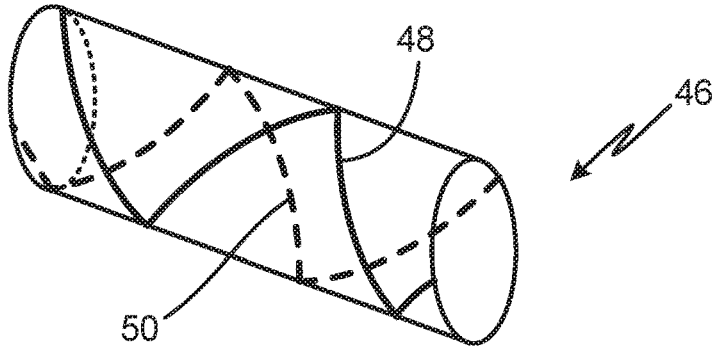
Figure 6:
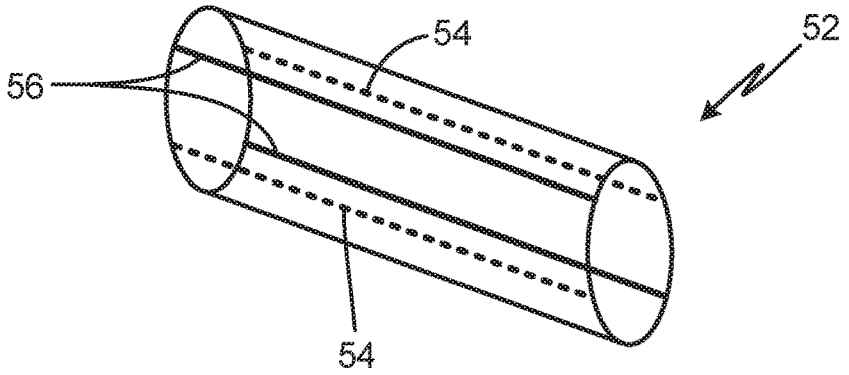

FIGS. 4-6 are perspective views of a printed heater tube with printed bus bars in various patterns. Generally, bus bar 30 of FIGS. 2, 3, can be printed as both hot bus bars and neutral bus bars on the surface of the tube to provide appropriate electrical connection to PTC heater 28.

FIG. 4 shows printed heater tube 40 with hot bus bar 42 and neutral bus bar 44 that are in parallel along the length of heater tube 40. Hot bus bar 42 and neutral bus bar 44 are both made of conductive ink, as discussed in reference to FIG. 2, and establishing opposing charges across tube 40. Hot bus bar 42 and neutral bust bar 44 provide an electrical connection to an accompanying PTC heater along the length of tube 40. The accompanying PTC heater (not shown) can be printed across heater tube 40 so that it overlaps with both hot bus bar 42 and neutral bus bar 44.

FIG. 5 shows printed heater tube 46 with hot bus bar 48 and neutral bus bar 50, which function in the same manner as the bus bars of FIG. 4. In tube 46, bus bars 48, 50 are in a spiral pattern around the surface of tube 46, allowing for additional electrical connection to a PTC heater (not shown) printed over bus bars 48, 50.

FIG. 6 shows printed heater tube 52 with two hot bus bars 54 and two neutral bus bars 56, which function in the same manner as the bus bars of FIG. 4. Bus bars 54, 56 are in a redundant dual circuit pattern. Bus bars 54, 56 can alternatively be spiraled similar to bus bars 46, 48 in FIG. 5. The varying geometric patterns of bus bars in FIGS. 4-6 can be selected depending on the desired PTC heater pattern, desired heater resistance range, heating consistency, and other factors affecting required heating of fluid running through the printed heater tubes.

FIGS. 7-10 are perspective views of printed heater tubes with printed PTC heaters in a variety of geometric patterns. PTC ink can be applied to the entire tube, with the exception of the ends of the tubes. The PTC ink in FIGS. 7-10 can be manufactured as discussed with reference to FIG. 2.

Figure 7:
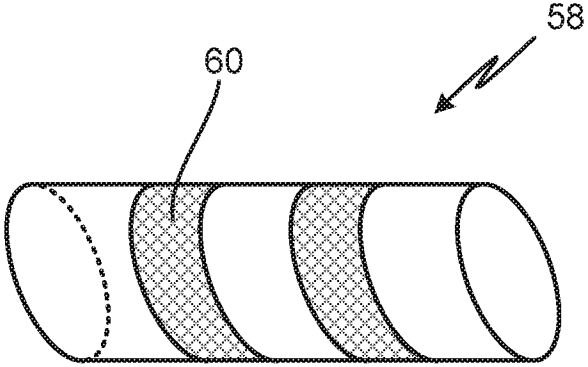
Figure 8:
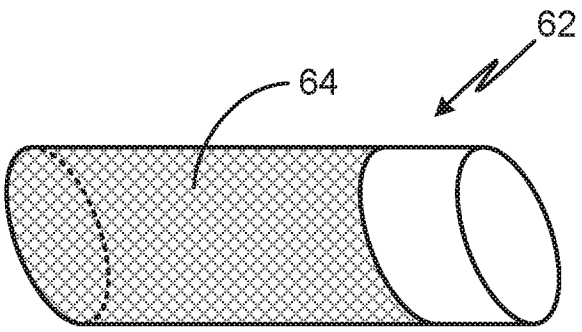

FIGS. 7-8 show only PTC ink on printed heater tubes. FIG. 7 shows printed heater tube 58 with PTC ink 60 printed in distinct, equal bands patterns along the length of tube 58. This allows for even distribution of PTC ink 60 across tube 58, and measured heating of fluid flowing through tube 58 when that fluid passes through the bands of PTC ink 60.

FIG. 8 shows printed heater tube 62 with PTC ink 64, where PTC ink 64 is a monolithic structure that acts as a sleeve around tube 62. In this embodiment, PTC ink 64 consistently heats fluid flowing through tube 62 along the length of one 62. Other geometric patterns of PTC ink can be used as desired for heating needs.

Figure 9:
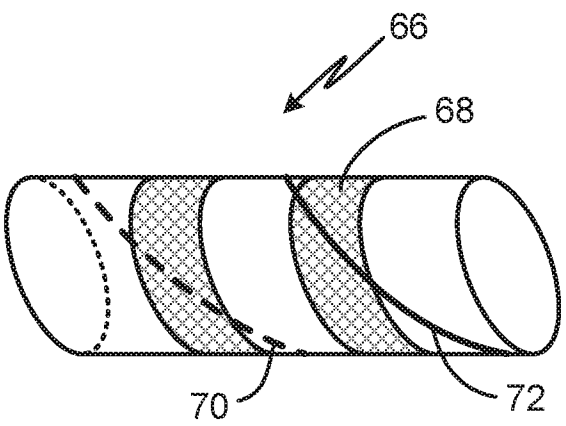
FIGS. 7-10 are perspective views of a printed heater tube with printed PTC heaters.
Figure 10:
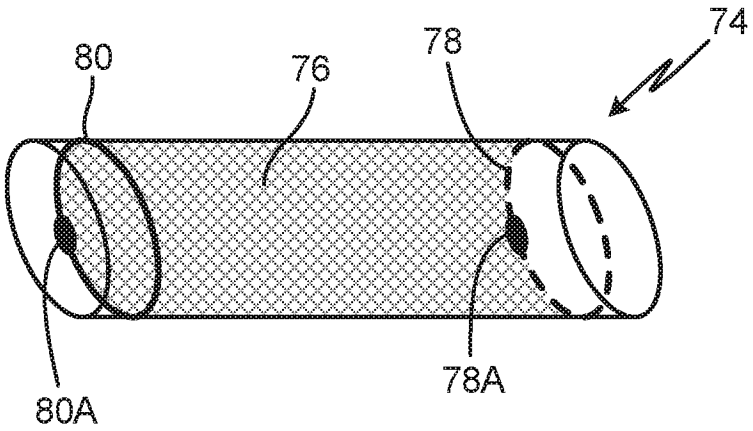

As shown in FIGS. 9-10, the conductive ink for the bus bars can be printed on top of the PTC ink. FIG. 9 shows printed heater tube 66 with PTC ink 68, hot bus bar 70 and neutral bus bar 72. Bus bars 70 and 72 are arranged similarly to the bus bars in FIG. 4. PTC ink 68, which is printed on top of bus bars 70 and 72, is spiral wound in the reversed direction of bus bars 70, 72 made of conductive ink to create the necessary electrical connections where PTC ink 68 overlaps with bus bars 70, 72.

FIG. 10 shows printed heater tube 74 with PTC ink 76, hot bus bar 78 and neutral bus bar 80 with electrical connections 78A and 80A, respectively. In the pattern of FIG. 10, bus bars 78, 80 with connections 78A, 80A are only at the ends of the tube. This works where PTC ink 76 is in a solid sleeve pattern as discussed with reference to FIG. 8, as electrical connections are maintained between PTC ink 76 and bus bars 78, 80.

Figure 12:
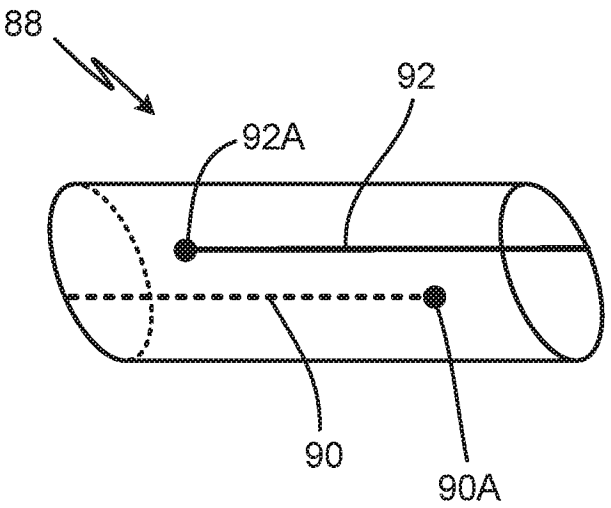
FIGS. 11-15 are perspective views of printed bus bar connections and heaters on heater tube.
Figure 11:
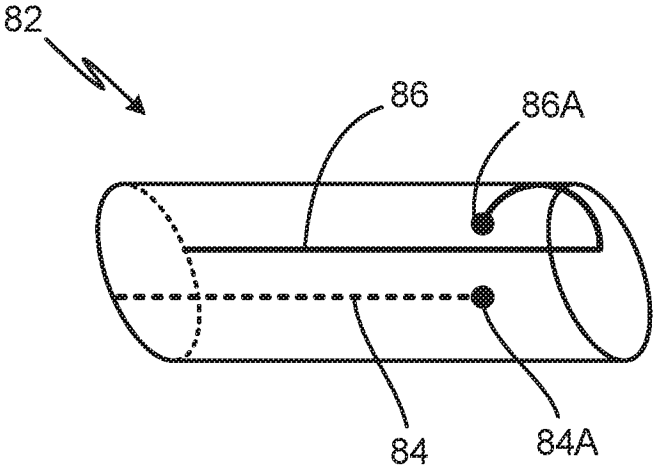

FIGS. 11-12 are perspective views of printed bus bar connections on heater tube. In FIG. 11, printed heater tube 82 contains hot bus bar 84 (with connection 84A) and neutral bus bar 86 (with connection 86A). Both bus bars 84, 86, have connections (84A, 86A) aligned at a single end of tube 82. In this case, a large patch of conductive ink can be printed over connections 84A, 86A, at the ends of bus bars 84, 86, for soldering or conductive adhesive to electrical wiring that provides power to bus bars 84, 86. The voltage from bus bar to bus bar near the bus bar connections will be higher than the voltage at the opposite end of tube 82 due to the location of connections 84A, 86A and the resistance of the bus bar conductive ink.

In FIG. 12, printed heater tube 88 has hot bus bar 90 (with connection 90A) and neutral bus bar 92 (with connection 92A). Here, connections 90A, 92A, to bus bars 90, 92 are at opposite ends of tube 88. This allows for constant voltage from one bus bar 90 to the other bus bar 92 along the length of tube 88.

Figure 14:
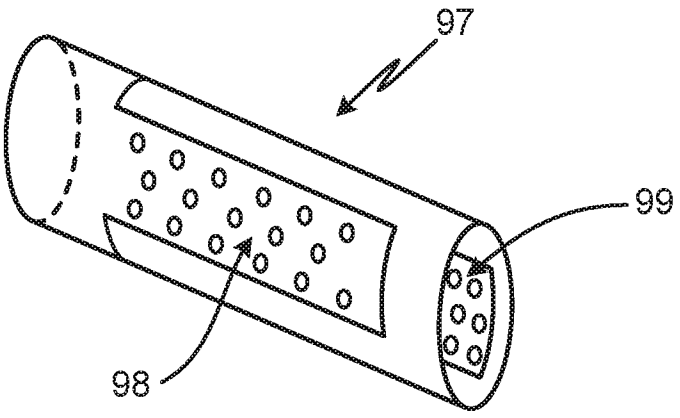
Figure 13:
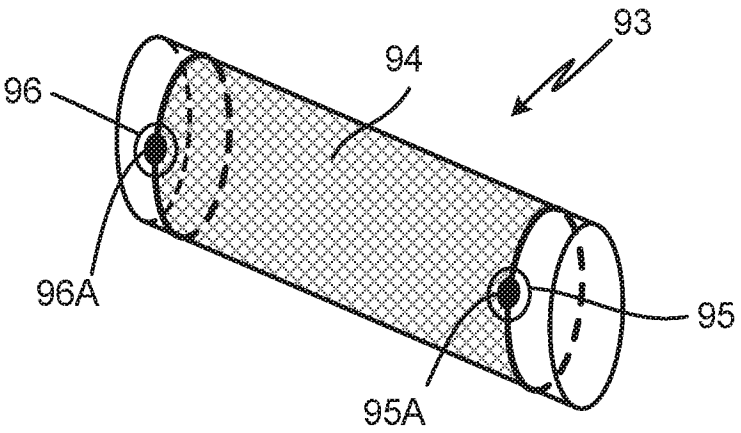
Figure 15:
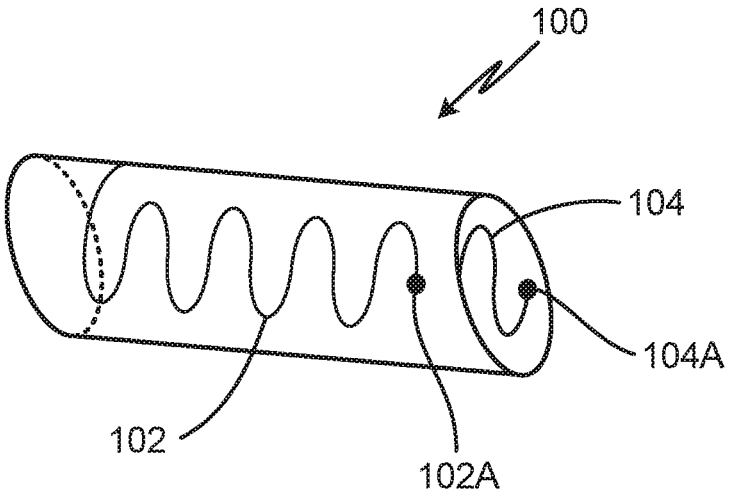

FIGS. 13-15 are perspective views of printed bus bars on heater tubes in heater tube assemblies printed without PTC ink. These types of assemblies do not have self-limiting properties, but can have higher power densities than assemblies with PTC ink.

In FIG. 13, printed heater tube 93 has conductive ink 94, hot bus bar 95 with connection 95A, and cold bus bar 96 with connection 96A. Here, connections 95A, 96A to bus bars 95, 96, are at opposite ends of tube 93, but connected through PTC heater 94. Conductive ink 94 is typically made of the same material as bus bars 95, 96, but may be printed thinner.

FIG. 14 shows printed heater tube 97 with hot bus bar 98 and cold bus bar 99. In this case, cold bus bar 99 is printed on one side of printed heater tube 97 and hot bus bar 98 is printed on the other side of printed heater tube 97. Bus bars 98, 99 have holes to lower the power density and add flexibility to printed heater tube 97. The density of bus bars 98, 99, can be varied by adjusting the hole size, shape, and pattern to adjust the power density down the length of printed heater tube 97.

Similarly, in FIG. 15 printed heater tube 100 has hot bus bar 102 (with connection 102A) on one side and cold bus bar 104 (with connection 104A) on the other, however, bus bars 102, 104, are in a snaking line across those surfaces instead of a straight pattern with lines.

Figure 16:
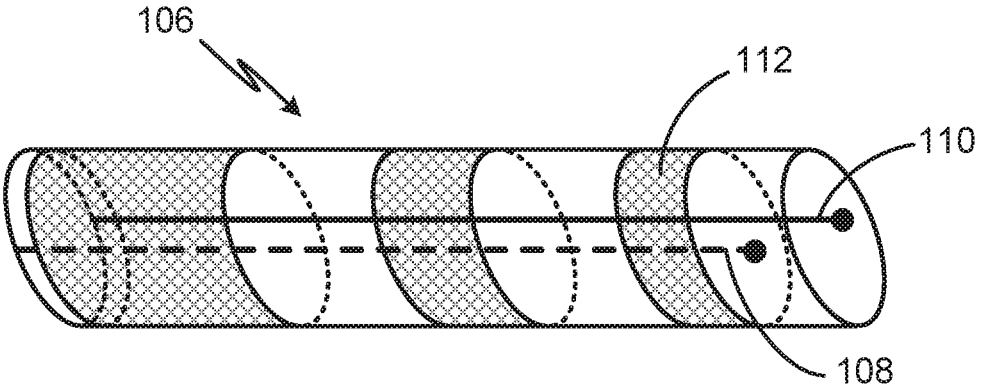
FIG. 16 is a perspective view of printed bus bars and heater allowing for constant power.

FIG. 16 is a perspective view of printed heater tube 106 with hot bus bar 108, neutral bus bar 110, and PTC ink 112. Bus bars 108, 110 run the length of heater tube 106 and terminate at the same end like the bus bars of FIG. 11. PTC ink 112 is separated into bands (similar to FIG. 7); however, the width of the bands of PTC ink 112 gradually decreases from the first end of tube 106 to the second end. Varying the width of the PTC ink bands along the length of the tube allows for constant power down the length of tube 106 despite both bus bars 108, 110 terminating at the same end.

Figure 17A:
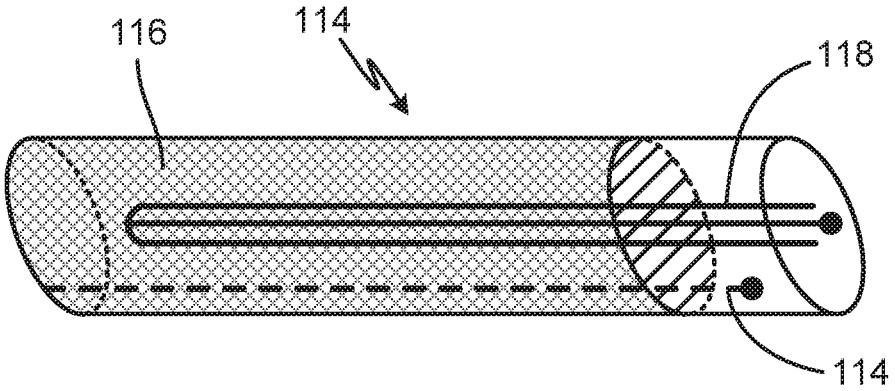
FIGS. 17A-17B are a perspective view and cross-sectional view of a printed PTC heater and bus bars allowing for constant voltage across the length of the tube.
Figure 17B:
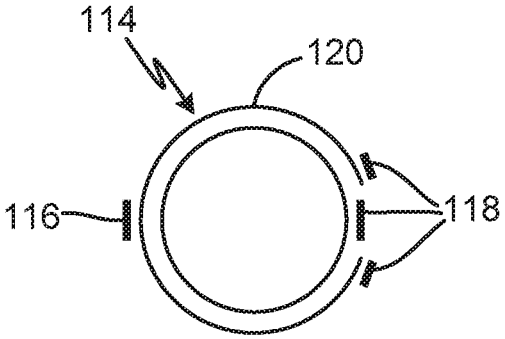

FIGS. 17A and 17B show printed heater tube 114 with hot bus bar 116, neutral bus bar 118, and PTC ink 120. In heater tube 114, hot bus bar 116 runs along one side of tube 114, while neutral bus bar 118 contains three strands running in parallel and meeting at the opposite end of tube 114 from the connector. PTC ink 120 on tube 114 is a sheet along the length of tube 114. This configuration keeps the voltage across PTC ink 120 constant down the length of tube 114 while still having both bus bar 116, 118, connections at the same end of tube 114. PTC ink 120 does not go all the way around tube 114 (see FIG. 15B). These geometric patterns for bus bars and PTC ink can be varied as needed.

Figure 18:
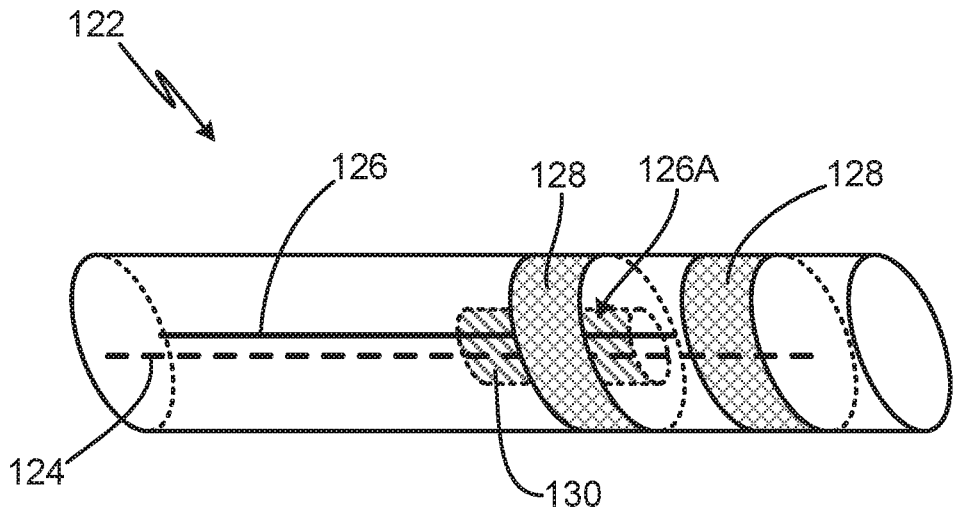
FIGS. 18-23 are cross-sectional views of printed bus bar electrical connections.

FIGS. 18-23 show printed bus bar connections on PTC heater tubes. FIG. 18 shows printed heater tube 122 with hot bus bar 124, cold bus bar 126 (with connection 126A), printed PTC heaters 128, and insulating layer 130. In printed heater tube 122, cold bus bar 126 connection 126A occurs under the printed ink of PTC heater 128, with insulator layer 130 preventing electrical shorting where cold bus bar 124 is electrically connected. In FIG. 13, connections are additively manufactured around the full circumference of heater tube 122. Bus bar 126 is shorter than bus bar 124 to keep the bus bar electrical connections separate. Insulating layer 130 is added locally on top of longer bus bar 124 to electrically isolate the bus bar connection 126A from bus bar 126.

Figure 19:
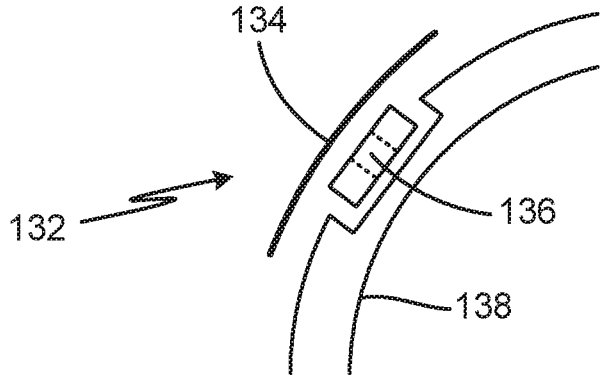
Figure 20:
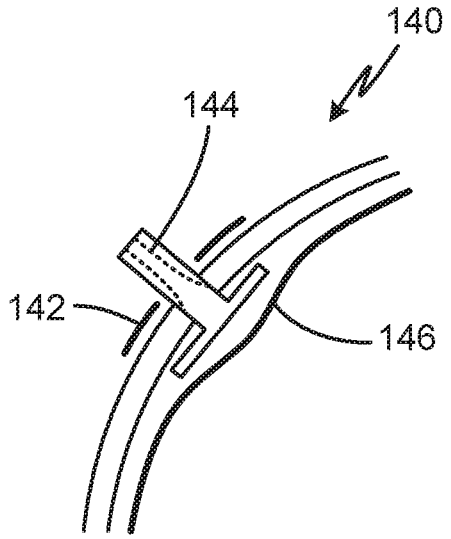
Figure 21:
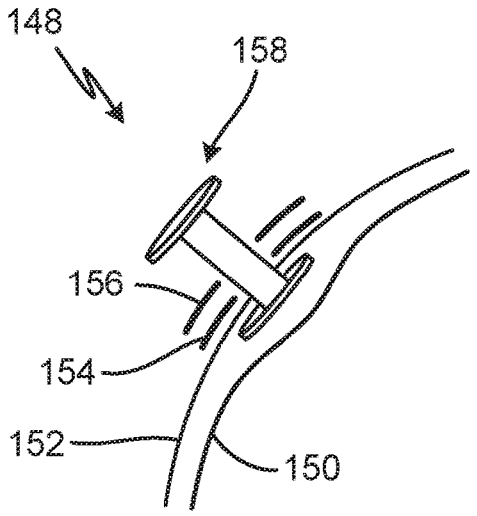
Figure 22:
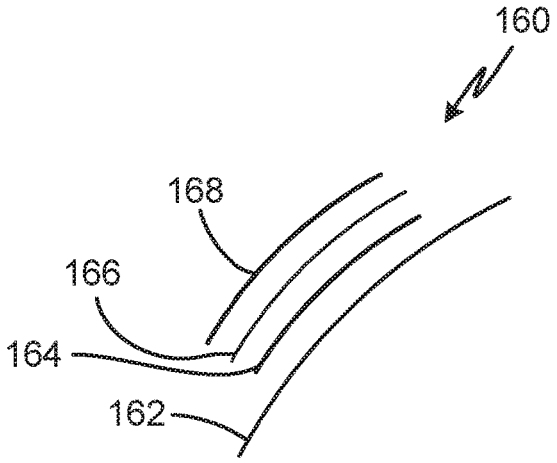
Figure 23:
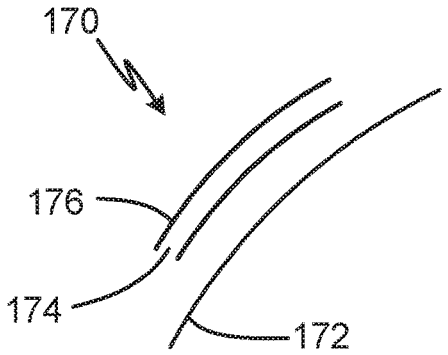

FIGS. 19-23 shows an alternative embodiment of making bus bar connections compared to connections in FIGS. 11-16. FIGS. 19-21 show mechanical connections, while FIGS. 22 and 23 show alternative methods of connections. FIG. 19 shows a cross-section of printed heater tube 132 with bus bar 134, connector 136, and insulating layer 138. Connector 136 (such as a nut) is embedded in the wall of tube 132, and is a threaded fastener. Connector 136 can be, for example, copper, aluminum, stainless steel, titanium, silver, or other appropriate metal. Bus bar 134 is printed over connector 136. Electrical terminals can be fastened to connector 136 while making contact with bus bar 134.

FIG. 20 shows a cross-section of printed heater tube 140 with bus bar 142, connector 144, and insulator 146. FIG. 20 shows connector 144 (a stud) running through the wall of tube 140, and is a removable threaded fastener. Connector 144 can be, for example, copper, aluminum, stainless steel, titanium, silver, or other appropriate metal. Bus bar 142 is printed around connector 144. Electrical terminals can be fastened to connector 144 while making contact with bus bar 142. Insulator 146 (a liner) must cover the head of the connector 144 to ensure electrical and chemical isolation of the fluid.

FIG. 21 shows a cross-section of printed heater tube 148 with insulator 150 on surface 152, bus bar 154, terminal 156, and rivet 158. Rivet 158 is a mechanical attachment that is non-removable and allows for electrical connection of bus bar 154. Rivet 158 can be, for example, copper, aluminum, stainless steel, titanium, silver, or other appropriate metal. Bus bar 154 overlays rivet 158 at terminal 156. Insulator 150 on surface 152 prevents rivet from electrically shorting.

FIG. 22 shows a cross-section of printed heater tube 160 with surface 162, bus bar 164, conductive adhesive 166, and metal foil 168. Metal foil 168 is attached to bus bar 164 by conductive adhesive 166. Metal foil 168 can be, for example, copper, aluminum, stainless steel, titanium, silver, or other appropriate metal. Conductive adhesive 166 is electrically conductive to provide electrical connection between bus bar 164 and metal foil 168, for example, a conductive epoxy such as MG Chemicals 8331 can be used.

FIG. 23 shows a cross-section of printed heater tube 170 with surface 172, bus bar 174 and solder paste 176. Bus bar 174 is printed on surface 172 of tube 170. Solder paste 176 is applied onto bus bar 174 to provide an electrical connection. Solder paste 176 is solder paste suitable for soldering wires such as MG Chemicals 4900P, and can be made of tin and silver mixed into a flux paste.

The disclosed printed heater tubes with PTC heaters are self-limiting heated components that are lightweight and compact on the surface of tubes transporting fluid.

Discussion of Possible Embodiments

The following are non-exclusive descriptions of possible embodiments of the present invention.

A heater tube assembly includes a tube, a bus bar network on the tube, a positive temperature coefficient heater on the tube, a closeout adhesive securing the bus bar network and the positive temperature coefficient heater to the tube, and an outer dielectric layer overlaying the bus bar network and the positive temperature coefficient heater. The bus bar network includes one or more layers of a first additively manufactured conductive ink. The positive temperature coefficient heater comprising one or more layers of a second additively manufactured conductive ink. The positive temperature coefficient heater is electrically connected to the bus bar network.

The assembly of the preceding paragraph can optionally include, additionally and/or alternatively, any one or more of the following features, configurations and/or additional components:

The tube is a conductive material selected from the group consisting of stainless steel and titanium.

The assembly includes an inner dielectric layer separating the bus bar network and the positive temperature from the tube.

The tube is a non-conductive material selected from the group consisting of polyetherimide, polyetheretherketone, polyphenylene sulfide, polyimide, ethylene tetrafluoroethylene, polyvinylchloride, polyvinylidene difluoride, and combinations thereof.

The tube includes glass fibers, glass spheres, glass hollow spheres, carbon black, carbon nanotubes, or carbon fibers.

The assembly includes a liner comprising a material selected from the group consisting of fluoropolymers, fluoroelastomers, silicone, polyolefin, acrylonitrile butadiene rubbers, ethylene propylene diene monomer rubbers, polyurethane, and combinations thereof.

The bus bar network comprises at least one hot bus bar and at least one neutral bus bar.

The bus bar network comprises a geometric pattern selected from the group consisting of a spiraled pattern, a redundant dual-circuit pattern, a crisscross pattern, or combinations thereof.

The first additively manufactured conductive ink is a silver-filled ink.

The positive temperature coefficient heater comprises a sheet covering at least a portion of the tube.

The positive temperature coefficient heater comprises a single sheet spiraled around the tube.

The positive temperature coefficient heater comprises a plurality of bands around the tube in parallel.

The width of each of the plurality of bands increases from a first end of the tube to a second end of the tube.

The second additively manufactured conductive ink is a positive temperature coefficient ink.

The closeout adhesive is a pressure sensitive adhesive or ethylene-vinyl acetate.

The outer dielectric layer comprises a material selected from the group consisting of braided stainless steel wire, braided titanium wire, braided aramid, braided dry fiberglass, carbon fiber composites, fiberglass composites, and combinations thereof.

The assembly includes one or more protection layers overlaying the outer dielectric layer.

A heater tube assembly includes a tube, a bus bar network including at least one hot bus bar and at least one neutral bus bar on the tube, a heater on the tube having a thickness between 0.0001 and 0.010 inches, a closeout adhesive securing the bus bar network and the heater to the tube, and an outer dielectric layer overlaying the bus bar network and the heater. The bus bar network is made of one or more layers of a first additively manufactured conductive ink, and the bus bar network is a geometric pattern selected from the group consisting of a spiraled pattern, a redundant dual-circuit pattern, a crisscross pattern, or combinations thereof. The heater includes a plurality of layers of a second additively manufactured conductive ink, each of the plurality of layers has a thickness of between 1 and 100 microns, and the heater is electrically connected to the bus bar network.

A method of making a heater tube assembly includes additively manufacturing one or more layers of a first conductive ink on a tube to create a bus bar, additively manufacturing one or more layers of a second conductive ink on a tube to create a positive temperature coefficient heater overlapping with the bus bar, closing out the bus bar and the positive temperature coefficient heater with an adhesive, and encapsulating the bus bar and the positive temperature coefficient heater with an outer dielectric layer.

The method of the preceding paragraph can optionally include, additionally and/or alternatively, any one or more of the following features, configurations and/or additional components:

Additively manufacturing is done with direct printing with extruded ink by micro-dispensing pumps, inkjet printing, or aerosol-gel printing.

While the invention has been described with reference to an exemplary embodiment(s), it will be understood by one skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A heater tube assembly comprising:

a tube;

a positive temperature coefficient heater on the tube, the positive temperature coefficient heater comprising one or more layers of a second additively manufactured conductive ink, wherein the positive temperature coefficient heater is electrically connected to a bus bar network on the tube, each of the one or more layers of the second additively manufactured conductive ink has a thickness of 1 micron to 100 microns, and the positive coefficient heater has a thickness between 0.0001 inch and 0.010 inch;

wherein the bus bar network comprises one or more layers of a first additively manufactured conductive ink, the bus bar network is positioned on top of and overlapping with at least a portion of the positive temperature coefficient heater such that the bus bar network and positive temperature coefficient heater are electrically connected and the bus bar network is configured to provide an electrical connection between the positive temperature coefficient heater and an outside controller and each of the one or more layers of the first additively manufactured conductive ink has a thickness of 1 micron to 100 microns and the bus bar network has a thickness between 0.0001 inch and 0.010 inch;

a closeout adhesive positioned on top of both the bus bar network and the positive coefficient heater to secure the bus bar network and the positive temperature coefficient heater to the tube; and an outer dielectric layer overlaying the closeout adhesive.

2. The assembly of claim 1, wherein the tube comprises a-conductive material selected from the group consisting of stainless steel and titanium.

3. The assembly of claim 2, further comprising an inner dielectric layer separating the bus bar network and the positive temperature from the tube.

4. The assembly of claim 1, wherein the tube comprises a non-conductive material selected from the group consisting of polyetherimide, polyetheretherketone, polyphenylene sulfide, polyimide, ethylene tetrafluoroethylene, polyvinylchloride, polyvinylidene difluoride, and combinations thereof.

5. The assembly of claim 4, wherein the tube further comprises glass fibers, glass spheres, glass hollow spheres, carbon black, carbon nanotubes, or carbon fibers.

6. The assembly of claim 1, further comprising a liner comprising a material selected from the group consisting of fluoropolymers, fluoroelastomers, silicone, polyolefin, acrylonitrile butadiene rubbers, ethylene propylene diene monomer rubbers, polyurethane, and combinations thereof.

7. The assembly of claim 1, wherein the bus bar network comprises at least one hot bus bar and at least one neutral bus bar.

8. The assembly of claim 7, wherein the bus bar network comprises a geometric pattern selected from the group consisting of a spiraled pattern, a redundant dual-circuit pattern, a crisscross pattern, or combinations thereof.

9. The assembly of claim 1, wherein the first additively manufactured conductive ink is a silver-filled ink.

10. The assembly of claim 1, wherein the positive temperature coefficient heater comprises a sheet covering at least a portion of the tube.

11. The assembly of claim 1, wherein the positive temperature coefficient heater comprises a single sheet spiraled around the tube.

12. The assembly of claim 1, wherein the positive temperature coefficient heater comprises a plurality of bands around the tube in parallel.

13. The assembly of claim 12, wherein the width of each of the plurality of bands increases from a first end of the tube to a second end of the tube.

14. The assembly of claim 1, wherein the second additively manufactured conductive ink is a positive temperature coefficient ink.

15. The assembly of claim 1, wherein the closeout adhesive is a pressure sensitive adhesive or ethylene-vinyl acetate.

16. The assembly of claim 1, wherein the outer dielectric layer comprises a material selected from the group consisting of braided stainless steel wire, braided titanium wire, braided aramid, braided dry fiberglass, carbon fiber composites, fiberglass composites, and combinations thereof.

17. The assembly of claim 1, further comprising one or more protection layers overlaying the outer dielectric layer.

18. A heater tube assembly comprising:

a tube;

a bus bar network comprising at least one hot bus bar and at least one neutral bus bar on the tube, the bus bar network comprising one or more layers of a first additively manufactured conductive ink, wherein the bus bar network further comprises a geometric pattern selected from the group consisting of a spiraled pattern, a redundant dual-circuit pattern, a crisscross pattern, or combinations thereof and wherein each of the one or more layers of the first additively manufactured conductive ink has a thickness of 1 micron to 100 microns and the bus bar network has a thickness between 0.0001 inch and 0.010 inch;

a positive temperature coefficient heater on the tube having a thickness between 0.0001 and 0.010 inches, the heater comprising a plurality of layers of a second additively manufactured conductive ink, each of the plurality of layers having a thickness of between 1 and 100 microns, wherein the positive temperature coefficient heater is electrically connected to the bus bar network and each of the one or more layers of the second additively manufactured conductive ink has a thickness of 1 micron to 100 microns and the positive coefficient heater has a thickness between 0.0001 inch and 0.010 inch;

a closeout adhesive securing the bus bar network and the heater to the tube; and an outer dielectric layer overlaying the bus bar network and the heater.

19. A method of making a heater tube assembly comprises:

additively manufacturing one or more layers of a second conductive ink on a tube to create a positive temperature coefficient heater that is electrically connected to a bus bar network, wherein each of the one or more layers of the second additively manufactured conductive ink has a thickness of 1 micron to 100 microns, and the positive coefficient heater has a thickness between 0.0001 inch and 0.010 inch;

additively manufacturing one or more layers of a first conductive ink on a tube to create the bus bar network, wherein the bus bar network is positioned on top of and overlapping with at least a portion of the positive temperature coefficient heater such that the bus bar network and positive temperature coefficient heater are electrically connected and the bus bar network is configured to provide an electrical connection between the positive temperature coefficient heater and an outside controller and each of the one or more layers of the first additively manufactured conductive ink has a thickness of 1 micron to 100 microns and the bus bar network has a thickness between 0.0001 inch and 0.010 inch;

closing out the bus bar network and the positive temperature coefficient heater with an adhesive positioned on top of both the bus bar network and the positive coefficient heater to secure the bus bar network and the positive temperature coefficient heater to the tube; and encapsulating the bus bar and the positive temperature coefficient heater with an outer dielectric layer.

20. The method of claim 19, wherein additively manufacturing is done with, direct printing with extruded ink by micro-dispensing pumps, inkjet printing, or aerosol-gel printing.

* * * * *